US008686914B2

(12) United States Patent
Lin et al.

(10) Patent No.: US 8,686,914 B2
(45) Date of Patent: Apr. 1, 2014

(54) ANTENNA MODULE AND DESIGN METHOD THEREOF

(75) Inventors: Yi-Cheng Lin, Taipei (TW); Yi-Chia Chen, Taipei (TW); Yi-Fong Lu, Taipei (TW)

(73) Assignee: National Taiwan University, Taipei (TW)

( * ) Notice: Subject to any disclaimer, the term of this patent is extended or adjusted under 35 U.S.C. 154(b) by 0 days.

(21) Appl. No.: 13/610,794

(22) Filed: Sep. 11, 2012

(65) Prior Publication Data

US 2013/0002504 A1 Jan. 3, 2013

Related U.S. Application Data

(63) Continuation-in-part of application No. 12/553,816, filed on Sep. 3, 2009, now Pat. No. 8,284,114.

(51) Int. Cl.
*H01Q 19/10* (2006.01)

(52) U.S. Cl.
USPC ..... 343/834; 343/700 MS

(58) Field of Classification Search
USPC ..... 343/700 MS, 846, 848, 834
See application file for complete search history.

(56) References Cited

U.S. PATENT DOCUMENTS

| | | | | |
|---|---|---|---|---|
| 5,382,959 | A * | 1/1995 | Pett et al. | 343/700 MS |
| 5,661,493 | A * | 8/1997 | Uher et al. | 343/700 MS |
| 6,061,027 | A * | 5/2000 | Legay et al. | 343/700 MS |

* cited by examiner

*Primary Examiner* — Hoang V Nguyen

(57) ABSTRACT

An antenna module is provided for transmitting a wireless signal. The antenna module includes a reflective superstrate, an antenna substrate, a feed conductor, a ground layer and a reflective pattern. The reflective superstrate includes a third surface and a fourth surface, wherein the third surface is opposite to the fourth surface. The antenna substrate includes a first surface and a second surface, wherein the first surface is opposite to the second surface. A feed conductor is disposed on the first surface. The ground layer is disposed on the second surface. The reflective pattern is formed on the third surface and faces the feed conductor, wherein a reflection gap d is formed between the reflective pattern and the ground layer, and the wireless signal has a wavelength λ, and the reflection gap d is between λ/20 and λ/80.

12 Claims, 8 Drawing Sheets

ANTENNA MODULE AND DESIGN METHOD THEREOF

CROSS REFERENCE TO RELATED APPLICATIONS

This application is a Continuation-In-Part of pending U.S. patent application Ser. No. 12/553,816, filed Sep. 3, 2009 and entitled "Antenna module and design method thereof", which claims the benefit of Taiwan Patent Application No. 098121311, filed on Jun. 25, 2009, the entirety of which is incorporated by reference herein.

BACKGROUND OF THE INVENTION

1. Field of the Invention

The present invention relates to an antenna module, and in particular relates to an antenna module having an Electromagnetic Band Gap cover.

2. Description of the Related Art

FIG. 1*a* shows a conventional antenna module 1, comprising a cover 10, an antenna substrate 20 and an antenna 30. The antenna 30 provides a wireless signal 2. The cover 10 increases reflection number of times of the wireless signal 2 to increase the energy intensity thereof. The cover 10 has a first reflection phase angle $\Phi_1$, and the antenna substrate 20 has a second reflection phase angle $\Phi_2$. The first reflection phase angle $\Phi_1$ is about −180°. The second reflection phase angle $\Phi_2$ is about −180°. To regulate the reflected wireless signal 2 in a phase, the following formula (A) may be utilized:

$$-\left(\frac{360}{\lambda}d1\times 2\right)=\phi_1+\phi_2=-360\times N \quad \text{(A)}$$

According to the formula (A), a distance d1 between the cover 10 and the antenna substrate 20 is at least equal to half of a wavelength of the wireless signal 2.

FIG. 1*b* shows another conventional antenna module 1', comprising a cover 10, an antenna substrate 20' and an antenna 30. The antenna 30 provides a wireless signal 2. The cover 10 increases reflection number of times of the wireless signal 2 to increase the energy intensity thereof. The cover 10 has a first reflection phase angle $\Phi_1$, and the antenna substrate 20' has a second reflection phase angle $\Phi_2'$. The first reflection phase angle $\Phi_1$ is about −180°. The second reflection phase angle $\Phi_2'$ is about 0°. To regulate the reflected wireless signal 2 in a phase, a distance d2 between the cover 10 and the antenna substrate 20' is at least equal to a quarter of a wavelength of the wireless signal 2.

Conventionally, the distance between the cover 10 and the antenna substrate 20(20') is large, and the volume of the antenna module is thus large.

BRIEF SUMMARY OF THE INVENTION

A detailed description is given in the following embodiments with reference to the accompanying drawings.

An antenna module is provided for transmitting a wireless signal. The antenna module includes a reflective superstrate, an antenna substrate, a feed conductor, a ground layer and a reflective pattern. The reflective superstrate includes a third surface and a fourth surface, wherein the third surface is opposite to the fourth surface. The antenna substrate includes a first surface and a second surface, wherein the first surface is opposite to the second surface. A feed conductor is disposed on the first surface. The ground layer is disposed on the second surface. The reflective pattern is formed on the third surface and faces the feed conductor, wherein a reflection gap d is formed between the reflective pattern and the ground layer, and the wireless signal has a wavelength λ, and the reflection gap d is between λ/20 and λ/80.

The antenna module of the embodiment provides return loss bandwidth of 23.59%, realized gain of 11.14 dBi and pure polarization. The antenna module of the embodiment is a wide bandwidth, high gain, and high cross polarization isolation antenna module. The antenna module of the embodiment can be manufactured by a print circuit board process, which has decreased dimensions, and decreased costs.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
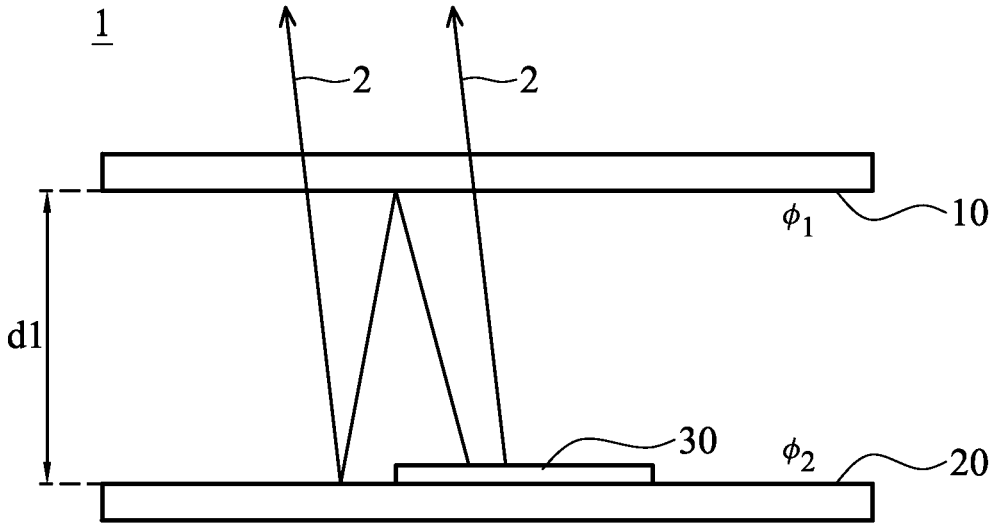
FIG. 1a (PRIOR ART)
FIG. 1*a* shows a conventional antenna module.
Figure 1B:
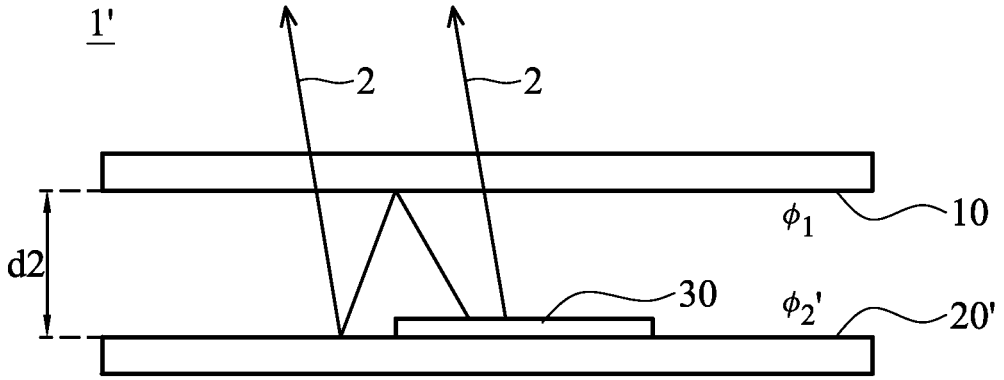
FIG. 1b (PRIOR ART)
FIG. 1*b* shows another conventional antenna module.
Figure 2:
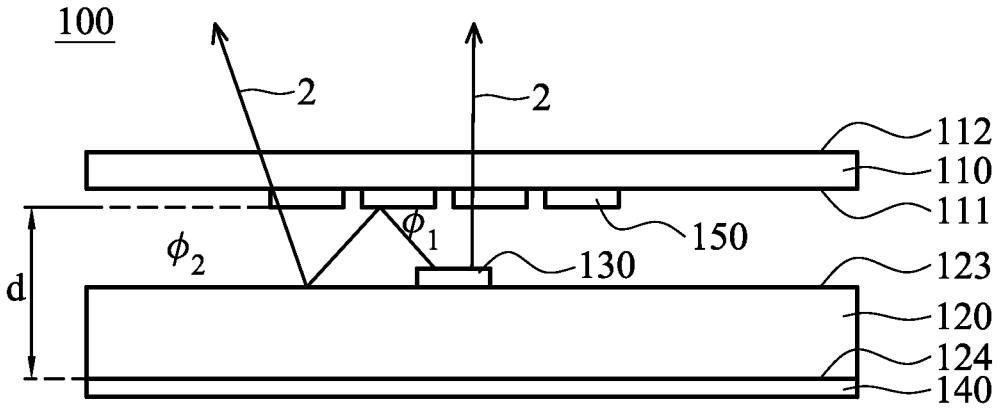
FIG. 2 shows an antenna module of the embodiment of the invention.

FIG. 2 shows an antenna module 100 of the embodiment of the invention, comprising a reflective superstrate 110, an antenna substrate 120, a feed conductor 130, a ground layer 140 and a reflective pattern 150. The reflective superstrate 110 is a partial reflective superstrate, comprising a third surface 111 and a fourth surface 112. The third surface 111 is opposite to the fourth surface 112. The antenna substrate 120 has a first surface 123 and a second surface 124. The first surface 123 is opposite to the second surface 124. The feed conductor 130 is disposed on the first surface 123. The ground layer 140 is disposed on the second surface 124. The reflective pattern 150 is formed on the third surface 111. The reflective pattern 150 is corresponding to the feed conductor 130. A reflection gap d is formed between the reflective pattern 150 and the ground layer 140. The reflective pattern 150 provides a first reflection phase angle $\Phi_1$, and the first surface provides a second reflection phase angle $\Phi_2$. In this embodiment, the first reflection phase angle $\Phi_1$ is substantially 180°, and the second reflection phase angle $\Phi_2$ is substantially 180°.

The embodiment of the invention differs from the conventional antenna module by abandoning conventional reflection phase angle theory. In conventional antenna module, the distance between the reflective pattern and the ground layer is at least equal to half of a wavelength $\lambda$ of the wireless signal. However, in the embodiment of the invention, the reflection gap d between the reflective pattern 150 and the ground layer 140 is between $\lambda/20$ and $\lambda/80$. The reflection gap d is far smaller than the wavelength $\lambda$.

Figure 6:
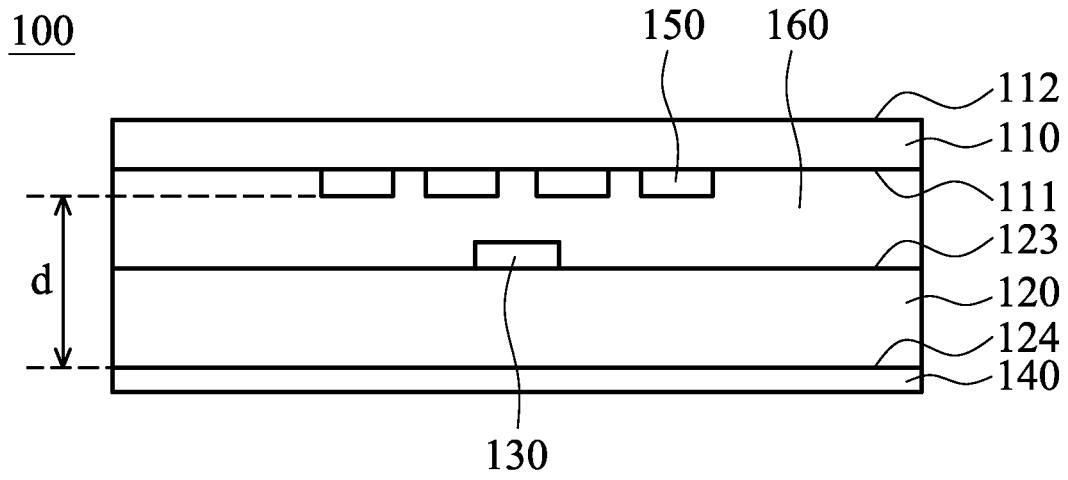
FIG. 6 shows an antenna module of an embodiment of the invention, wherein the reflection gap is filled by dielectric material.
Figure 7:
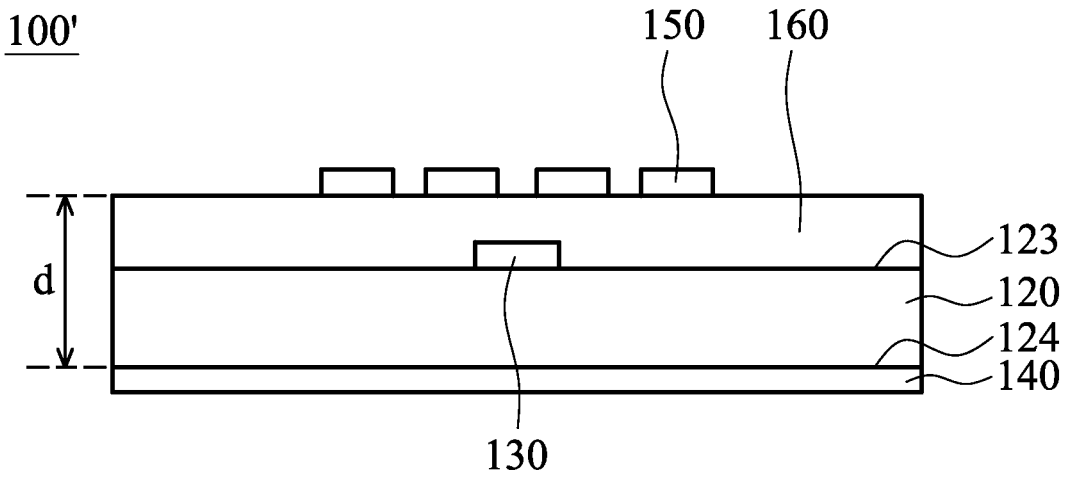
FIG. 7 shows an antenna module of an embodiment of the invention, wherein the reflective superstrate is omitted.

The material of the reflective superstrate 110 and the antenna substrate 120 can be dielectric material. The reflection gap d can be an empty space (filled by air), or, as shown in FIG. 6, filled by dielectric material 160. Additionally, as shown in FIG. 7, in an embodiment, the reflective superstrate can be omitted, and the reflective pattern 150 can be formed on the dielectric material 160.

Figure 3:
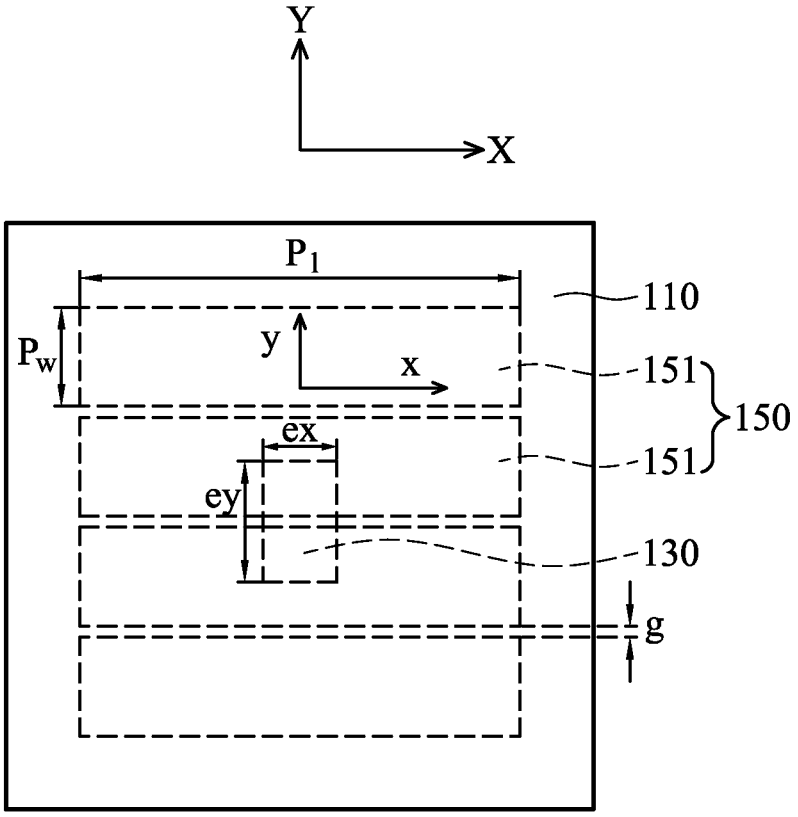
FIG. 3 shows the reflective pattern and the antenna of one embodiment of the invention.

FIG. 3 shows the reflective pattern 150 and the feed conductor 130 of one embodiment of the invention. The reflective pattern 150 comprises a plurality of reflective units 151. Each reflective unit 151 comprises a major axis x and a minor axis y. The reflective units 151 are equidistantly arranged along a first direction the Y, and the minor axes y of the reflective units 151 are parallel to the first direction the Y. In this embodiment, the reflective units are rectangular, and the reflective units are arranged into a 4×1 matrix. A unit gap g is formed between contiguous reflective units. A length $P_1$ of the reflective unit 151 is 50 mm, a width $P_w$ of the reflective unit 151 is 11.975 mm, the unit gap g is 0.7 mm, a width ex of the feed conductor 130 is 8.5 mm, a length ey of the feed conductor 130 is 14.54 mm, and the reflection gap d is 1 mm.

In the embodiment above, by modifying the length $P_1$ of the reflective unit, the width $P_w$ of the reflective unit, and the unit gap g, the performance of the antenna module can be modified. For example, the unit gap g can be within a range between $\lambda/100$ and $\lambda/300$.

In the embodiment, the feed conductor 130 is a patch, providing a wireless signal 2, wherein the wireless signal comprises a major polarization direction and a cross polarization direction, and the first direction the Y is parallel to the major polarization direction.

Figure 9A:
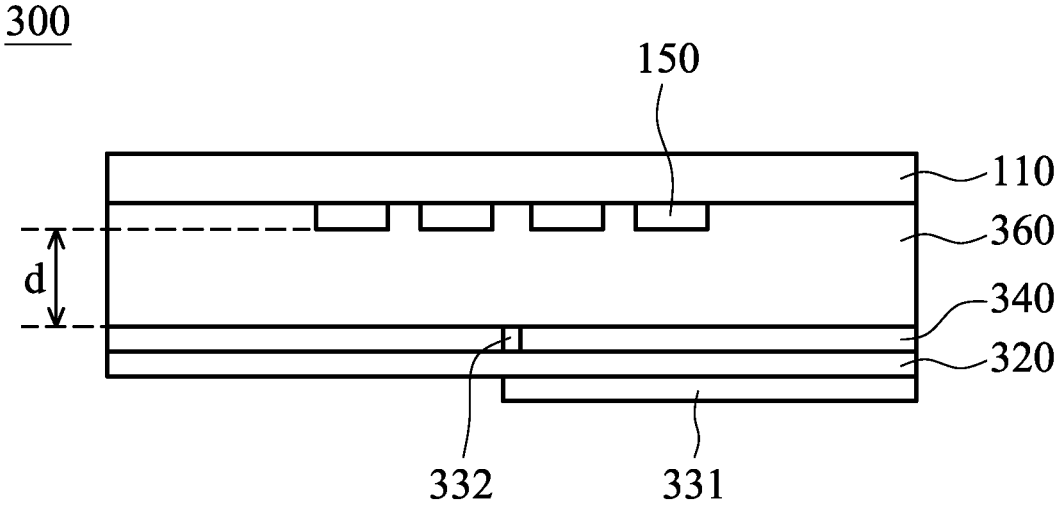
FIGS. 9A and 9B show an antenna module of another embodiment of the invention, which is a leaky wave antenna.
Figure 9B:
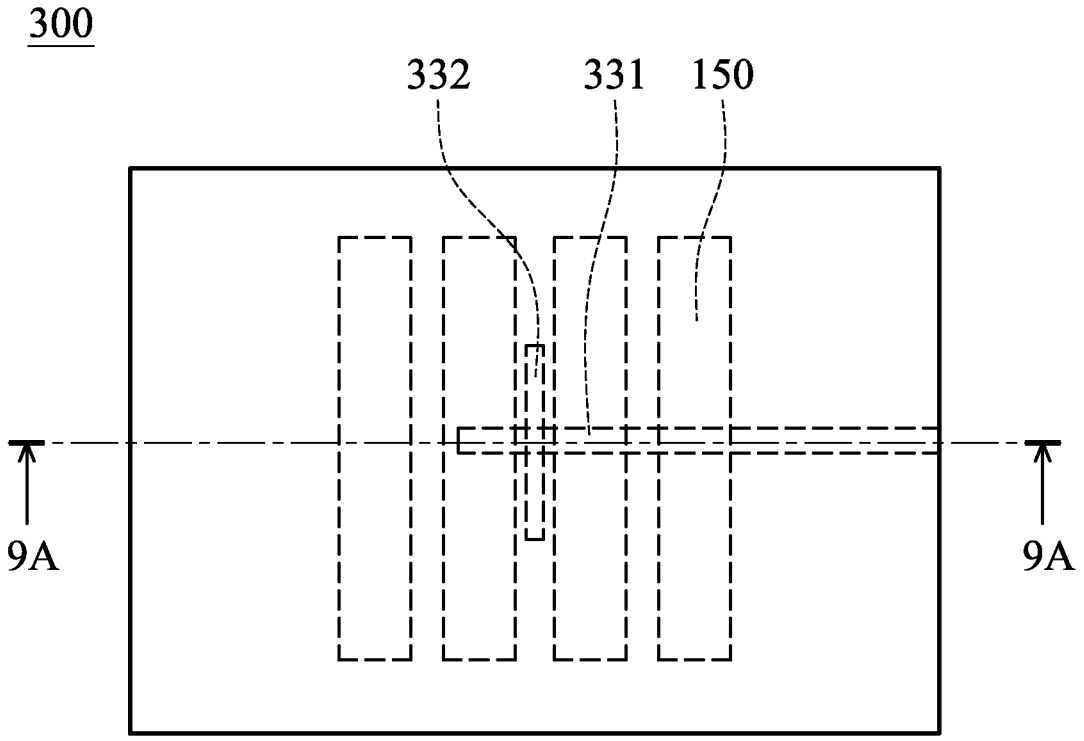

In the embodiment, the feed conductor is a patch, and the antenna module is a patch antenna. However, the invention is not limited thereto. The antenna module can also be fed by a slot feeding design, a probe feeding design, a network feeding design or other antenna design. FIGS. 9A and 9B shows an antenna module 300 of another embodiment of the invention, wherein the antenna module 300 is a leaky wave antenna. The antenna module 300 has an antenna substrate 320, a dielectric material 360 and a ground layer 340. A feeding slot 332 is formed on the ground layer 340. A feeding line (feed conductor) 331 is disposed on the antenna substrate 320, and feeds signals to the feeding slot 332.

Figure 4A:
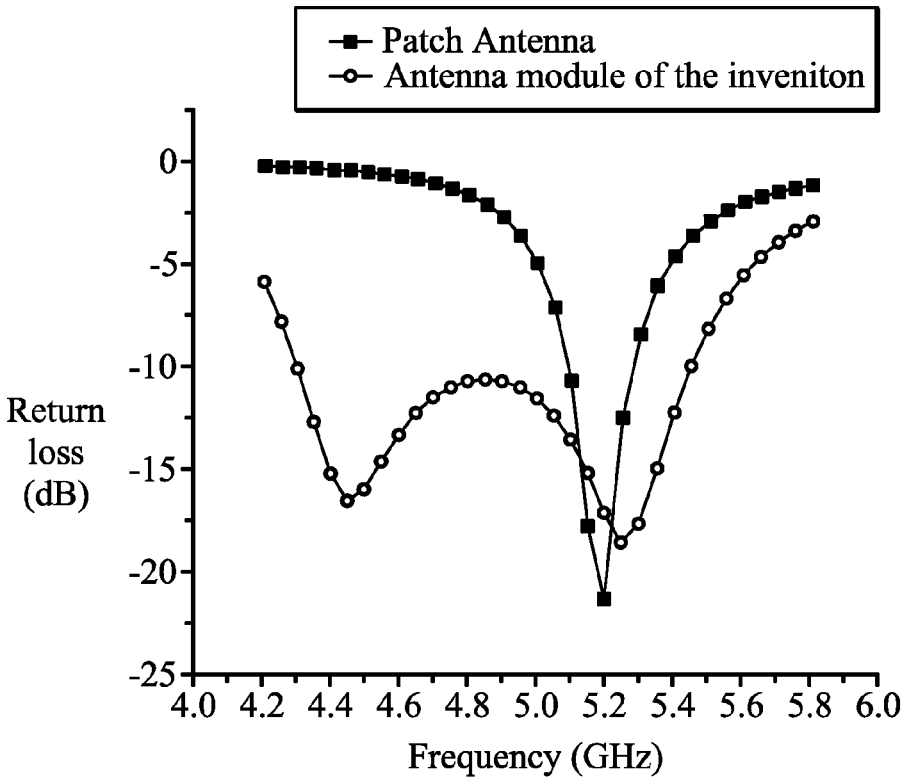
FIG. 4*a* shows the return loss of the antenna module of the embodiment of the invention when compared to a simple Patch Antenna.

FIG. 4*a* shows the return loss of the antenna module 100 of the embodiment of the invention when compared to a simple Patch Antenna. As shown in FIG. 4*a*, the antenna module 100 of the embodiment of the invention has greater bandwidth.

Figure 4B:
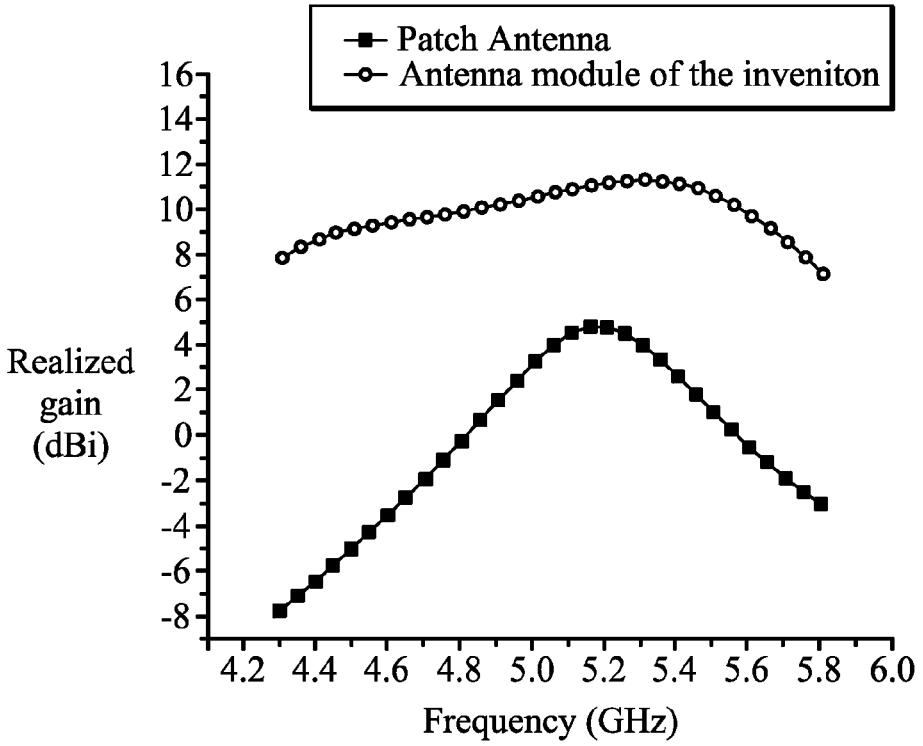
FIG. 4*b* shows the realized gain of the antenna module of the embodiment of the invention when compared to a simple Patch Antenna.

FIG. 4*b* shows the realized gain of the antenna module 100 of the embodiment of the invention when compared to a simple Patch Antenna. As shown in FIG. 4*b*, the antenna module 100 of the embodiment of the invention has increased realized gain.

Figure 4C:
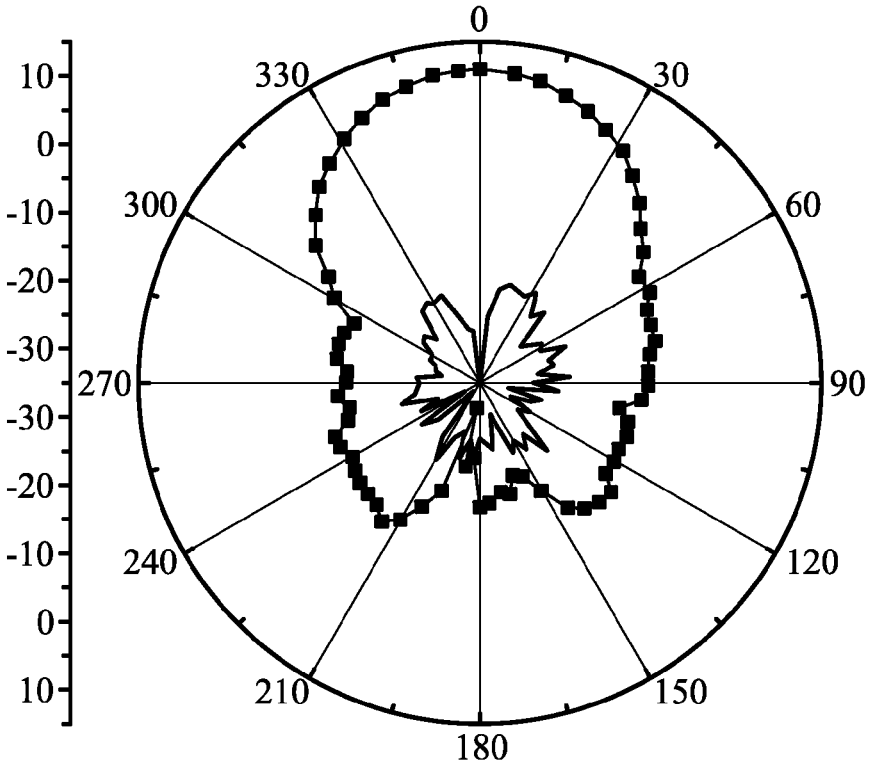
FIG. 4*c* shows the realized gain pattern on the XZ plane of the antenna module when transmitting a wireless signal of 5.2 GHz.
Figure 4D:
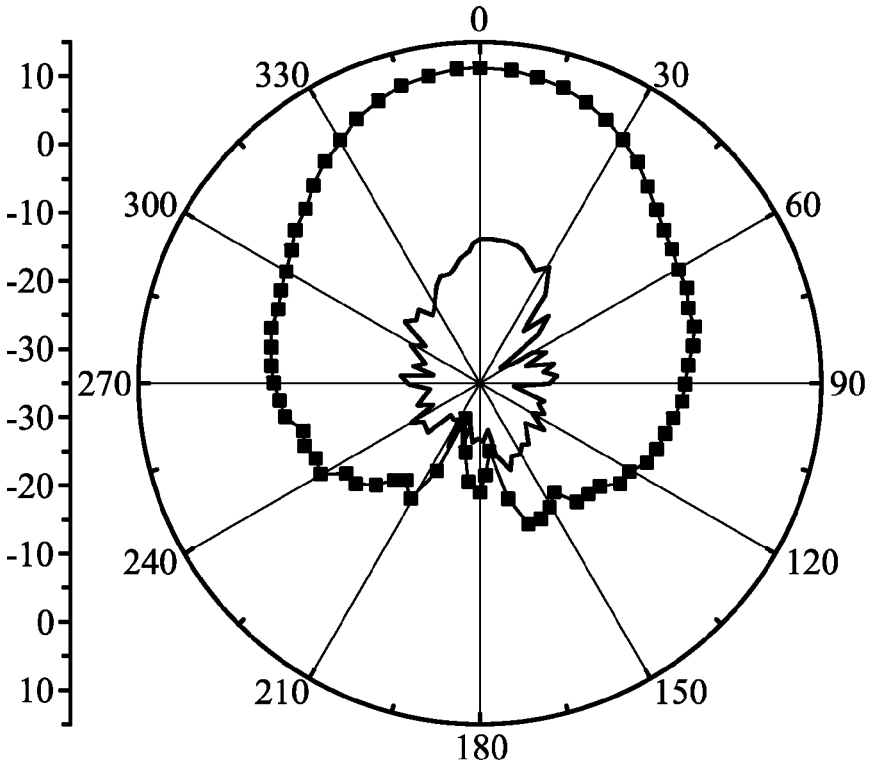
FIG. 4*d* shows the realized gain pattern on the YZ plane of the antenna module when transmitting a wireless signal of 5.2 GHz.

FIG. 4*c* shows the realized gain pattern on the XZ plane of the antenna module 100 when transmitting a wireless signal of 5.2 GHz. FIG. 4*d* shows the realized gain pattern on the YZ plane of the antenna module 100 when transmitting a wireless signal of 5.2 GHz. As shown in FIGS. 4*c* and 4*d*, the antenna module 100 of the embodiment provides improved directivity and cross polarization isolation.

The antenna module of the embodiment provides return loss bandwidth of 23.59%, realized gain of 11.14 dBi and pure polarization. The antenna module of the embodiment is a high bandwidth, high gain, and high cross polarization isolation antenna module. The antenna module of the embodiment can be manufactured by a print circuit board process, which has decreased dimensions, and decreased costs.

Figure 5:
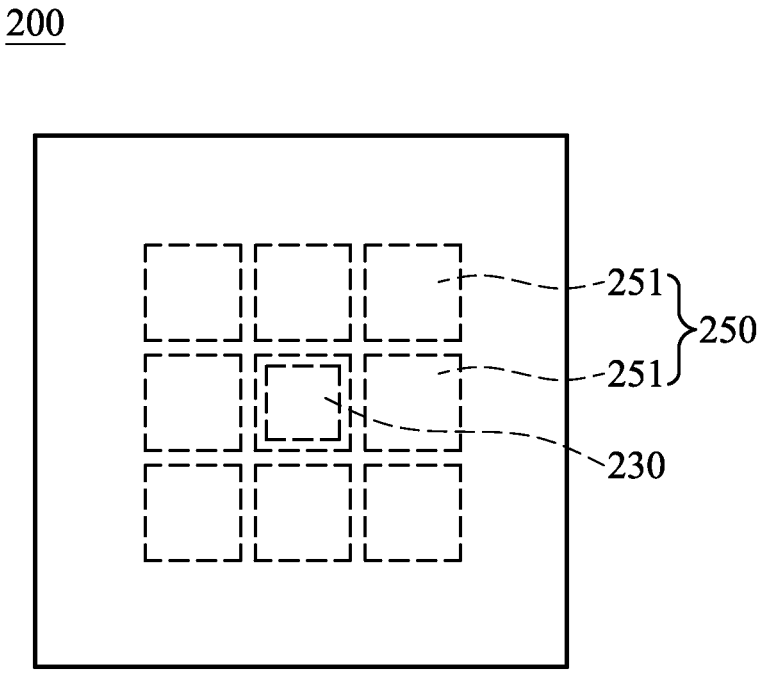
FIG. 5 shows an antenna module of another embodiment of the invention.

FIG. 5 shows an antenna module 200 of another embodiment of the invention, wherein the reflective pattern 250 comprises a plurality of reflective units 251. The reflective units 251 are square, and equidistantly arranged into a phalanx. In this embodiment, the feed conductor 230 is a patch.

Figure 8A:
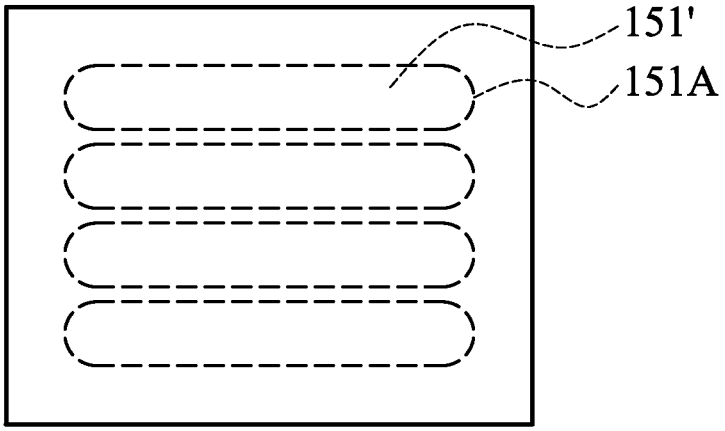
FIG. 8A shows an antenna module of an embodiment of the invention, wherein each reflective unit has two tapered ends.
Figure 8B:
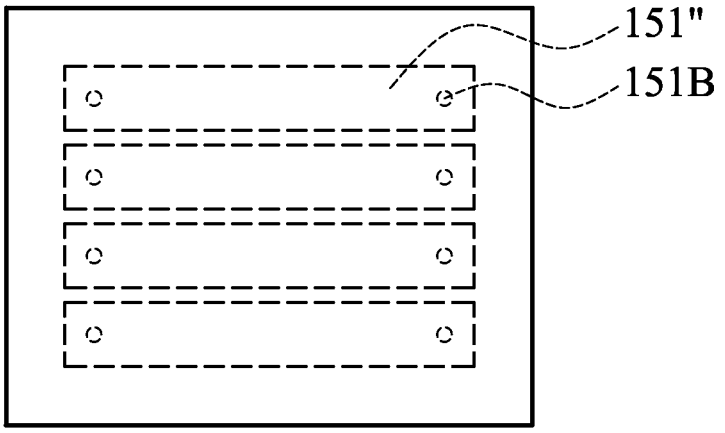
FIG. 8B shows an antenna module of an embodiment of the invention, wherein each reflective unit has two ends, and the end of the reflective unit is shorted to the ground layer.

FIGS. 8A and 8B show antenna modules of modified embodiments of the invention. In FIG. 8A, each reflective unit 151' has two tapered ends 151A, wherein the reflection phase angle of the reflective pattern of FIG. 8A is 90°.

In FIG. 8B, each reflective unit 151" has two ends, and the end of the reflective unit 151" is shorted to the ground layer by via holes 151B, wherein the reflection phase angle of the reflective pattern of FIG. 8B is 180°.

The reflective pattern mentioned above is an Electromagnetic Band Gap pattern. The reflective pattern can be modified.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna module for transmitting a wireless signal, comprising:

a reflective superstrate, comprising a third surface and a fourth surface, wherein the third surface is opposite to the fourth surface;

an antenna substrate, comprising a first surface and a second surface, wherein the first surface is opposite to the second surface;

a feed conductor, disposed on the first surface;

a ground layer, disposed on the second surface; and a reflective pattern, formed on the third surface and faces the feed conductor, wherein a reflection gap is formed between the reflective pattern and the ground layer, and the feed conductor is located between the ground layer and the reflective pattern, wherein the wireless signal has a wavelength $\lambda$, and the reflection gap is between $\lambda/20$ and $\lambda/80$, wherein the reflective pattern comprises a plurality of reflective units, each reflective unit comprises a major axis and a minor axis, the reflective units are equidistantly arranged along a first direction, and the minor axes of the reflective units are parallel to the first direction, wherein the reflective units are longitudinal, wherein each reflective unit has two ends, and each of the ends of the reflective unit is shorted to the ground layer.

2. The antenna module as claimed in claim 1, wherein a unit gap g is formed between contiguous reflective units.

3. The antenna module as claimed in claim 2, wherein the unit gap is between λ/100 and λ/300.

4. The antenna module as claimed in claim 1, wherein the wireless signal comprises a major polarization direction and a cross polarization direction, and the first direction is parallel to the major polarization direction.

5. The antenna module as claimed in claim 1, wherein the reflective units are arranged into a 4×1 matrix.

6. The antenna module as claimed in claim 1, wherein the reflective units are rectangular.

7. The antenna module as claimed in claim 1, wherein each reflective unit has two tapered ends.

8. The antenna module as claimed in claim 1, wherein a dielectric material is filled in the reflective gap.

9. An antenna module for transmitting a wireless signal, comprising:

an antenna substrate, comprising a first surface and a second surface, wherein the first surface is opposite to the second surface;

a feed conductor, disposed on the first surface;

a ground layer, disposed on the second surface;

a dielectric material, covering the feed conductor, and a reflective pattern, formed on a surface of the dielectric material, wherein a reflection gap is formed between the reflective pattern and the ground layer, and the feed conductor is located between the ground layer and the reflective pattern, wherein the wireless signal has a wavelength λ, and the reflection gap is between λ/20 and λ/80, wherein the reflective pattern comprises a plurality of reflective units, each reflective unit comprises a major axis and a minor axis, the reflective units are equidistantly arranged along a first direction, the minor axes of the reflective units are parallel to the first direction, and the reflective units are longitudinal, wherein the reflective units are arranged into a 4×1 matrix.

10. An antenna module for transmitting a wireless signal, comprising:

a reflective pattern;

a ground layer, wherein a reflection gap is formed between the reflective pattern and the ground layer, and the wireless signal has a wavelength λ, and the reflection gap is between λ/20 and λ/80;

a feed means, corresponding to the reflective pattern and feeding a feeding signal to the antenna module, wherein the reflective pattern comprises a plurality of reflective units, each reflective unit comprises a major axis and a minor axis, the reflective units are equidistantly arranged along a first direction, the minor axes of the reflective units are parallel to the first direction, and the reflective units are longitudinal.

11. The antenna module as claimed in claim 10, wherein the reflective units are arranged into a 4×1 matrix.

12. An antenna module for transmitting a wireless signal, comprising:

an antenna substrate, comprising a first surface and a second surface, wherein the first surface is opposite to the second surface;

a ground layer, disposed on the first surface, wherein a feeding slot is formed on the ground layer;

a feed conductor, disposed on the second surface, wherein the feed conductor feeds a feeding signal to the feeding slot;

a dielectric material, covering the ground layer; and a reflective pattern, wherein a reflection gap is formed between the reflective pattern and the ground layer, and the feeding slot is located between the feed conductor and the reflective pattern, wherein the wireless signal has a wavelength λ, and the reflection gap is between λ/20 and λ/80, wherein the reflective pattern comprises a plurality of reflective units, each reflective unit comprises a major axis and a minor axis, the reflective units are equidistantly arranged along a first direction, the minor axes of the reflective units are parallel to the first direction, and the reflective units are longitudinal, wherein the reflective units are arranged into a 4×1 matrix.

* * * * *